United States Patent [19]

Makino et al.

[11] Patent Number: 4,724,192

[45] Date of Patent: Feb. 9, 1988

[54] ELECTROPHOTOGRAPHIC PHOTORECEPTOR CONTAINING A BISSTILBENE COMPOUND

[75] Inventors: Naonori Makino; Seiji Horie; Syu Watarai; Hideo Sato, all of Kanagawa, Japan

[73] Assignee: Fuji Photo Film Co., Ltd., Kanagawa, Japan

[21] Appl. No.: 892,010

[22] Filed: Aug. 1, 1986

[30] Foreign Application Priority Data

Aug. 5, 1985 [JP] Japan ..... 60-172016

[51] Int. Cl.[4] ..... G03G 15/02

[52] U.S. Cl. ..... 430/58; 430/59; 430/69; 430/83; 430/79

[58] Field of Search ..... 546/270; 568/643; 430/73, 74, 79, 58, 59, 69, 83

[56] References Cited

U.S. PATENT DOCUMENTS 3,873,312 3/1975 Contois et al. ..... 430/74

4,594,304 6/1986 Watarai et al. ..... 430/74

*Primary Examiner*—John L. Goodrow

*Attorney, Agent, or Firm*—Sughrue, Mion, Zinn, Macpeak & Seas

[57] ABSTRACT

An electrophotographic photoreceptor is disclosed, comprising a conductive support having provided thereon a light-sensitive layer containing at least one of a specific type of bisstilbene compound as a photoconductive substance or a charge transporting material. The photoreceptor has high sensitivity, a small residual potential, and stability to ozone, light, or heat.

17 Claims, 4 Drawing Figures

ELECTROPHOTOGRAPHIC PHOTORECEPTOR CONTAINING A BISSTILBENE COMPOUND

FIELD OF THE INVENTION

This invention relates to an electrophotographic photoreceptor, and, more particularly, to an electrophotographic photoreceptor having a layer containing a novel charge transporting material and to an electrophotographic photoreceptor having a layer containing a novel photoconductive substance.

BACKGROUND OF THE INVENTION

In electrophotographic photoreceptors, photoconduction takes place through (1) a process of generating electric charge upon exposure to light and (2) a process of charge transport.

Electrophotographic photoreceptors wherein both the processes (1) and (2) are effected by the same substance include selenium photoreceptors, and those wherein the processes (1) and (2) are separately carried out by different substances include a combination of amorphous selenium and poly-N-vinylcarbazole. The latter technique in which the processes (1) and (2) are effected by different substances advantageously allows a wide choice in the kind of materials to be used for photoreceptors, which leads to improvement of electrophotographic characteristics, such as sensitivity of photoreceptors, acceptable potential, etc. Further, such a large choice of materials means that materials favorable to the formation of photoreceptor coating films can be selected from a wide range.

Photoreceptors in electrophotography are essentially required to satisfy the following performance properties: (1) they can be charged at an appropriate potential in the dark; (2) dark decay of the charge is small; (3) they are capable of rapidly discharging upon light irradiation; and the like. The above-described inorganic substances certainly have many merits but, at the same time, involve various demerits. For example, selenium, which is widely employed at this time, fully satisfies the above requirements (1) to (3), but involves difficult conditions of production, with the ultimate disadvantage of increased production cost. Further, it is difficult to shape selenium in the form of a belt due to its lack of flexibility, and selenium photoreceptors need delicate handling due to high sensitivity to heat and mechanical shocks. Photoreceptors in which cadmium sulfide or zinc oxide is dispersed in a resin binder have mechanical drawbacks in terms of surface smoothness, hardness, tensile strength, abrasion resistance, and the like, so that they cannot be used repeatedly.

In attempts to overcome these disadvantages of inorganic materials, electrophotographic photoreceptors using various organic materials have recently been proposed, and some of them have been turned to practical use. For example, U.S. Pat. No. 3,484,237 discloses a photoreceptor comprising poly-N-carbazole and 2,4,7-trinitrofluoren-9-one; Japanese Patent Publication No. 25658/73 discloses a photoreceptor comprising poly-N-vinylcarbazole sensitized with a pyrylium compound; and Japanese Patent Application (OPI) No. 10785/72 describes a photoreceptor comprising mainly an eutectic complex composed of a dye and a resin (the term "OPI" as used herein refers to a "published unexamined Japanese patent application").

Another attempt has been directed to highly sensitive electrophotographic photoreceptors comprising a combination of a material capable of generating electric charge by light (called charge generating material) and a material capable of transporting the generated charge (called charge transporting material). Examples of such photoreceptors so far proposed include a photoreceptor having a charge generating layer having further provided thereon a charge transporting layer as disclosed in U.S. Pat. No. 3,791,826; a photoreceptor having a charge transporting layer having further provided thereon a charge generating layer as disclosed in U.S. Pat. No. 3,573,906; and a photoreceptor having a light-sensitive layer comprising a charge transporting material having dispersed therein a charge generating material as taught in U.S. Pat. No. 3,764,315. With respect to this type of photoreceptors, many useful charge generating materials have so far been proposed, but not so many as for truly useful chage transporting materials. Excellent charge transporting materials are those capable of transmitting light of a wavelength causing a charge generating material to generate charges through themselves to the charge generating material, maintaining a sufficient potential when charged, and rapidly transporting the charges generated by the charge generating material.

SUMMARY OF THE INVENTION

An object of this invention is to provide an electrophotographic photoreceptor having an electrophotographic light-sensitive layer containing a charge transporting material permeable to light of a wavelength causing charge generation.

Another object of this invention is to provide an electrophotographic photoreceptor having an electrophotographic light-sensitive layer showing high sensitivity and a low residual potential.

Still another object of this invention is to provide an electrophotographic photoreceptor having an electrophotographic light-sensitive layer which is stable to oxidation by ozone generated by corona charge, stable to light or heat, and in which dark decay of the potential is reduced, the residual potential is not liable to increase or vary due to repeated use, and sensitivity is not liable to vary.

A further object of this invention is to provide an electrophotographic photoreceptor which can be handled and disposed of with safety, having an electrophotographic light-sensitive layer containing a non-toxic or less toxic charge transporting material which can be synthesized from non-toxic or less toxic starting compounds.

A still further object of this invention is to provide a stable and uniform charge transporting layer having high film strength and high fatigue performance.

As a result of extensive investigations, the inventors have found that bisstilbene compounds as hereinafter described effectively serve as charge transporting materials in electrophotographic photoreceptors, and reached the present invention based on this finding.

The present invention relates to an electrophotographic photoreceptor having a light-sensitive layer containing at least one bisstilbene compound represented by formula (I)

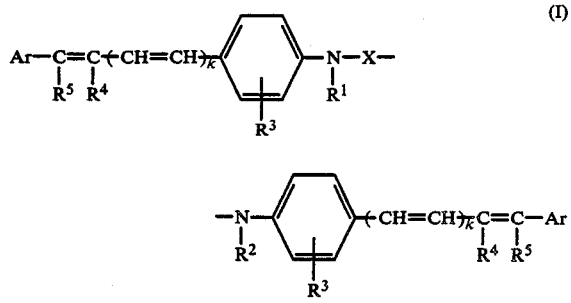

(I)

wherein Ar represents a substituted or unsubstituted aromatic carbon ring residue or a substituted or unsubstituted aromatic heterocyclic residue; $R^1$ and $R^2$ (which may be the same or different) each represents a substituted or unsubstituted alkyl group, a substituted or unsubstituted aralkyl group, or a substituted or unsubstituted aryl group, or $R^1$ and $R^2$ together form an N-containing heterocyclic group; $R^3$ represents a hydrogen atom, a halogen atom, a substituted or unsubstituted alkyl group, a substituted or unsubstituted alkoxy group, a substituted or unsubstituted aryl group, a substituted or unsubstituted aralkyl group, or a substituted or unsubstituted aryloxy group; $R^4$ represents a hydrogen atom, a substituted or unsubstituted alkyl group, a substituted or unsubstituted aralkyl group, or a substituted or unsubstituted aryl group; $R^5$ represents a hydrogen atom, a halogen atom, a nitro group, a cyano group, a substituted or unsubstituted alkyl group, a substituted or unsubstituted aralkyl group, or a substituted or unsubstituted aryl group, or $R^5$ together with Ar forms an aromatic ring; k represents 0 or 1; and X represents a group represented by formula (II)

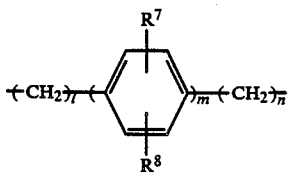

(II)

wherein $R^7$ and $R^8$ each represents a hydrogen atom, a halogen atom, a substituted or unsubstituted alkyl group, a substituted or unsubstituted alkoxy group, a substituted or unsubstituted aryl group, or a substituted or unsubstituted aryloxy group, or $R^7$ and $R^8$ may be taken together to form a condensed polycyclic aromatic ring; l and n each represents 0 or an integer of from 1 to 6; and m represents 0 or 1.

DETAILED DESCRIPTION OF THE INVENTION

Figure 1:
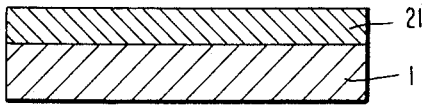
FIGS. 1 to 4 each illustrates a corss-sectional view of the electrophotographic photoreceptor according to the present invention.

The bisstilbene compounds represented by formula (I) can be used in any light-sensitive layer according to the following embodiments (1) to (4):

(1) A single-layer light-sensitive layer containing both a charge generating material and the bisstilbene compound (I).

(2) A single-layer light-sensitive layer containing both a sensitizing dye and the bisstilbene compound (I).

(3) A laminated light-sensitive layer comprising a charge generating layer containing a charge generating material and a charge transporting layer containing the bisstilbene compound (I).

(4) A laminated light-sensitive layer comprising a charge generating layer containing a charge generating material and the bisstilbene compound (I) and a charge transporting layer containing a charge transporting material.

The bisstilbene compounds of formula (I) according to the present invention will be described in more detail.

The unsubstituted alkyl group as represented by $R^1$, $R^2$, $R^3$, $R^4$, or $R^5$ includes a methyl group, an ethyl group, a propyl group, a butyl group, a pentyl group, a hexyl group, an octyl group, a nonyl group, a dodecyl group, an isopropyl group, an isobutyl group, an isopentyl group, a 4-methylpentyl group, a sec-butyl group, a t-butyl group, etc.

The unsubstituted aralkyl group as represented by $R^1$, $R^2$, $R^3$, $R^4$, or $R^5$ includes a benzyl group, a phenethyl group, a 1-naphthylmethyl group, a 2-naphthylmethyl group, a 1-anthrylmethyl group, a benzhydryl group, etc.

The unsubstituted aryl group as represented by $R^1$, $R^2$, $R^3$, $R^4$, or $R^5$ includes a phenyl group, a 1-naphthyl group, a 2-naphthyl group, an anthryl group, a pyrenyl group, an acenaphthenyl group, a fluorenyl group, etc.

The N-containing heterocyclic group jointly formed by $R^1$ and $R^2$ includes a piperazinyl group, etc.

The halogen atom as represented by $R^3$ or $R^5$ includes a chlorine atom, a bromine atom, and an iodine atom.

The unsubstituted alkoxy group as represented by $R^3$ includes a methoxy group, an ethoxy group, a propoxy group, a butoxy group, a pentyloxy group, etc. The unsubstituted aryloxy group as represented by $R^3$ includes a phenoxy group, an o-tolyloxy group, an m-tolyloxy group, a p-tolyloxy group, a 1-naphthyloxy group, a 2-naphthyloxy group, etc.

The unsubstituted aromatic carbon ring residue as represented by Ar includes a phenyl group, a naphthyl group, an anthryl group, a pyrenyl group, an acenaphthenyl group, a fluorenyl group, etc. The unsubstituted aromatic heterocyclic residue for Ar includes a pyridyl group, a thienyl group, a carbazolyl group, etc.

The aromatic ring residue jointly formed by $R^5$ and Ar includes a 9-fluorenylidene group, etc.

The substituents for the substituted alkyl, aralkyl, or aryl group as represented by $R^1$, $R^2$, $R^3$, $R^4$, or $R^5$ include a halogen atom, e.g., a chlorine atom, a bromine atom, and an iodine atom; an alkoxy group, e.g., a methoxy group, an ethoxy group, a propoxy group, a butoxy group, a pentyloxy group; an aryloxy group, e.g., a phenoxy group, an o-tolyloxy group, an m-tolyloxy group, a p-tolyloxy group, a 1-naphthyloxy group and a 2-naphthyloxy group; a dialkylamino group, e.g., a dimethylamino group, a diethylamino group, a dipropylamino group, an N-methyl-N-ethylamino group, an N-ethyl-N-propylamino group, and an N-methyl-N-propylamino group; a diarylamino group, e.g., a diphenylamino group; an alkylthio group, e.g., a methylthio group, an ethylthio group, and a propylthio group; and an N-containing heterocyclic group, e.g., a piperidino group, a 1-piperazinyl group a morpholino group, and a 1-pyrrolidyl group.

In addition to the above-enumerated substituents, the substituents for the substituted aryl group further include an alkyl group, e.g., a methyl group, an ethyl group, a propyl group, a butyl group, a pentyl group, an isopropyl group, an isobutyl group, and an isopentyl group.

The substituents for the substituted aromatic carbon ring residue or substituted aromatic heterocyclic ring residue as represented by Ar include those enumerated for the substituted aryl group.

Specific examples of the group represented by formula (II), i.e., X, include a methylene group, an ethylene group, a propylene group, a butylene group, a pentylene group, a hexylene group, a laurylene group, a p-xylylene group, a 2,5-dichloro-p-xylylene group, a 2,3,5,6-tetramethyl-p-xylylene group, a 1,4-dimethylenenaphthalene group, etc.

$R^1$ and $R^2$ each preferably represents a methyl group, an ethyl group, an n-butyl group, an n-hexyl group, a benzyl group, and a phenyl group. $R^3$ preferably represents a hydrogen atom, a methyl group, an ethyl group, a methoxy group, an ethoxy group, a fluorine atom, a chlorine atom, and a bromine atom. $R^4$ preferably represents a hydrogen atom, a methyl group, an ethyl group, a phenyl group, a benzyl group, a p-(dimethylamino)-phenyl group, and a p-(diethylamino)phenyl group, with a hydrogen atom being particularly preferred. $R^5$ preferably represents a hydrogen atom or a phenyl group.

k preferably represents 0.

X preferably represents an ethylene group, a butylene group, a pentylene group, a hexylene group, and a p-xylylene group.

Specific but non-limiting examples of the bisstilbene compounds represented by formula (I) according to the present invention are shown below.

(1)

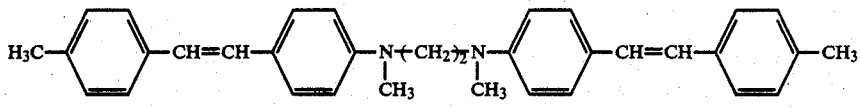

(2)

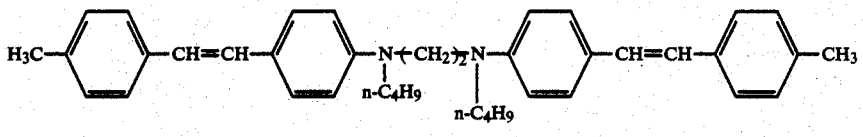

(3)

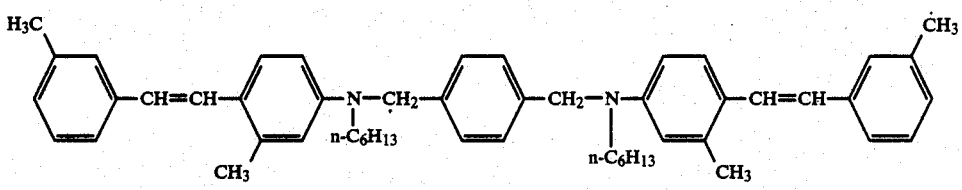

(4)

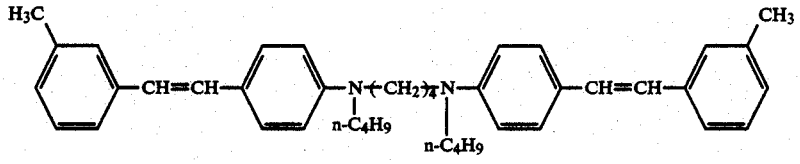

(5)

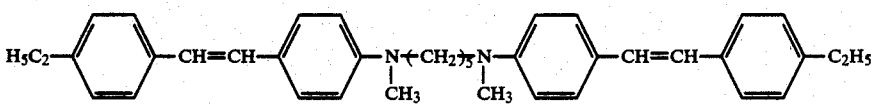

(6)

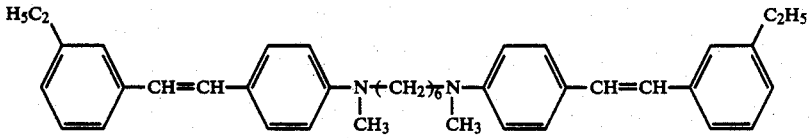

(7)

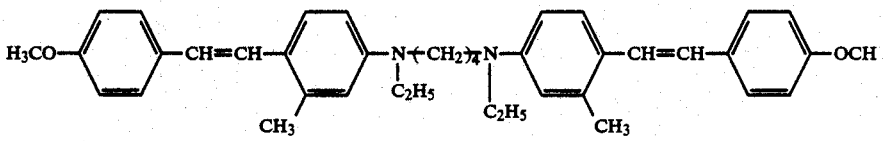

(8)

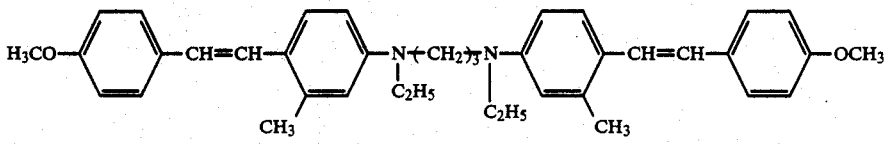

-continued
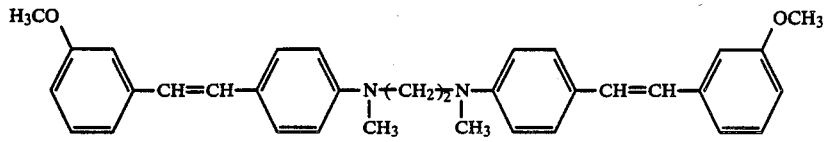
(9)
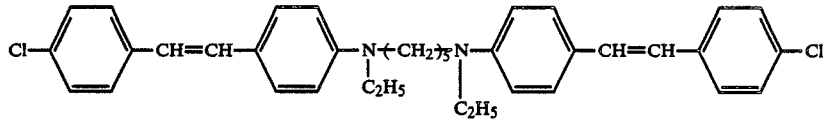
(10)
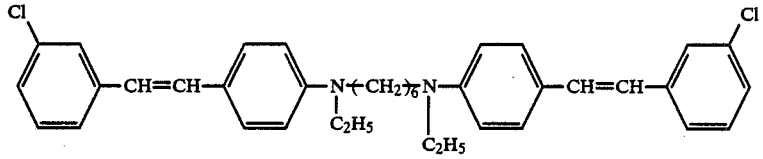
(11)
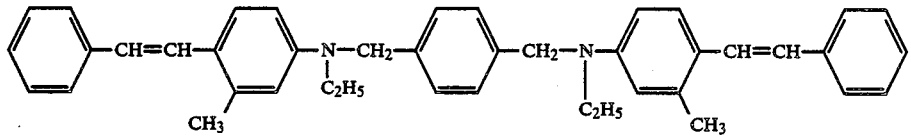
(12)
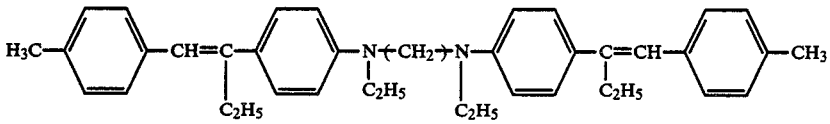
(13)
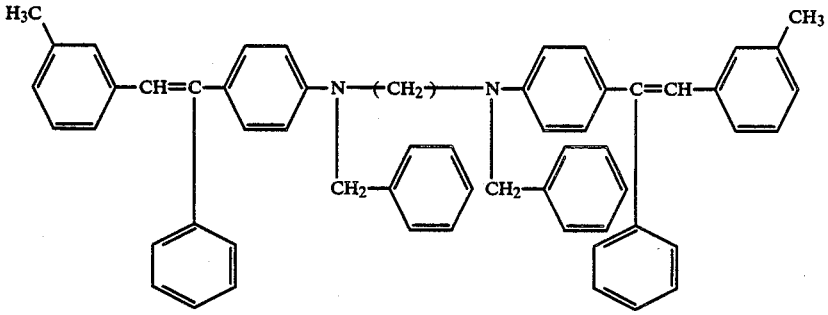
(14)
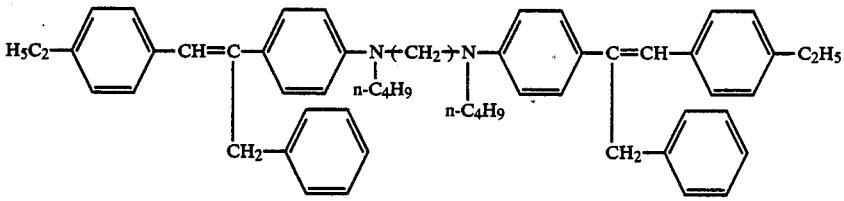
(15)
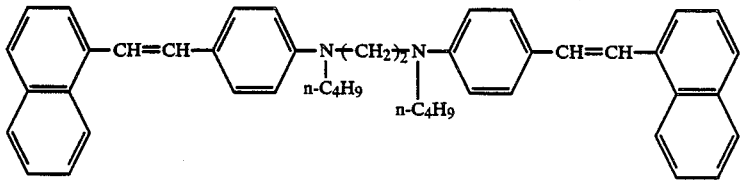
(16)

-continued
(17)
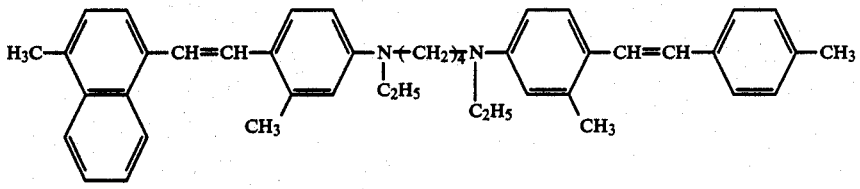
(18)
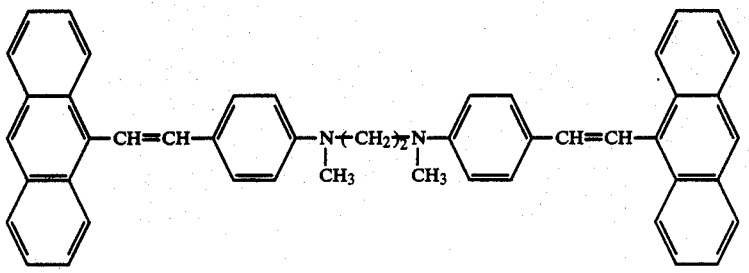
(19)
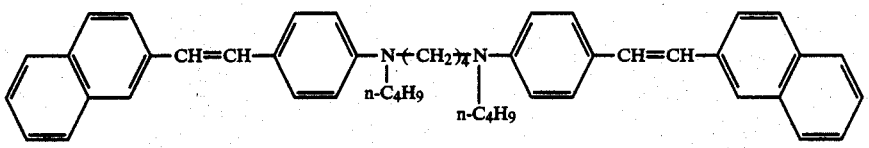
(20)
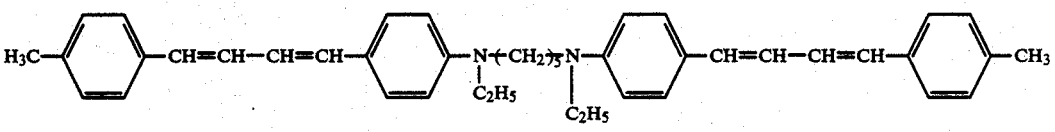
(21)
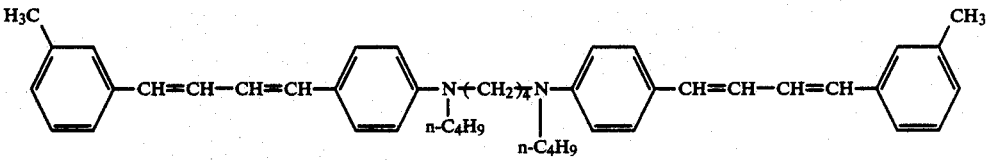
(22)
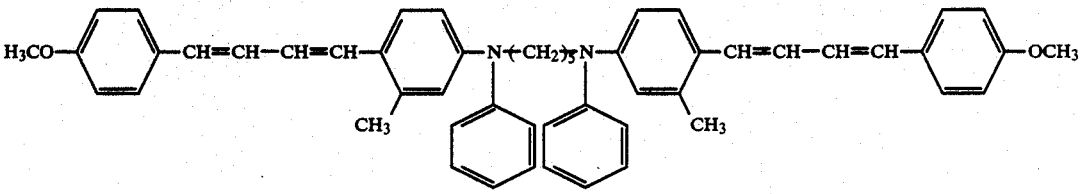
(23)
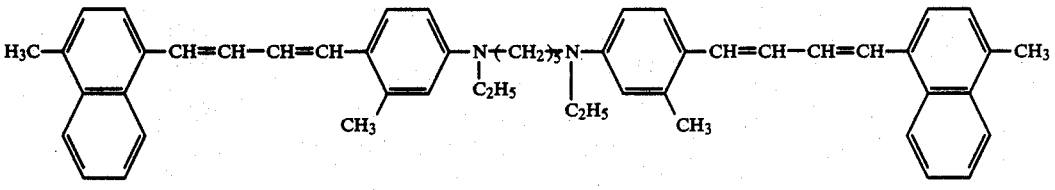
(24)
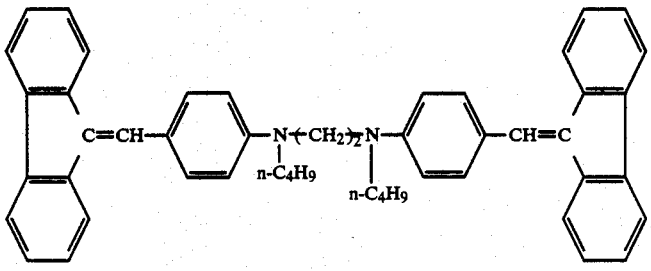

-continued (25)

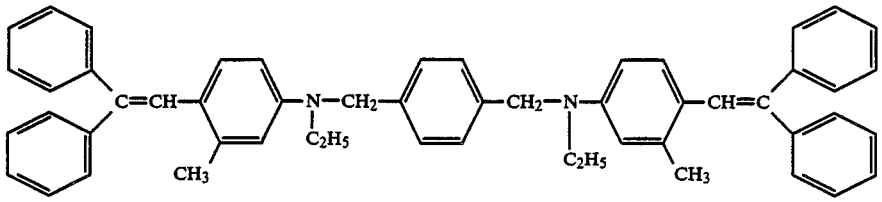

(26)

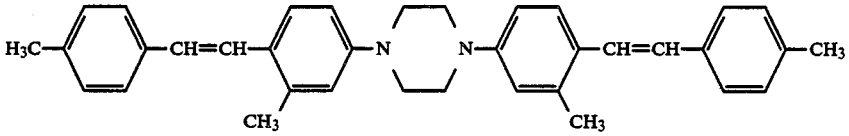

(27)

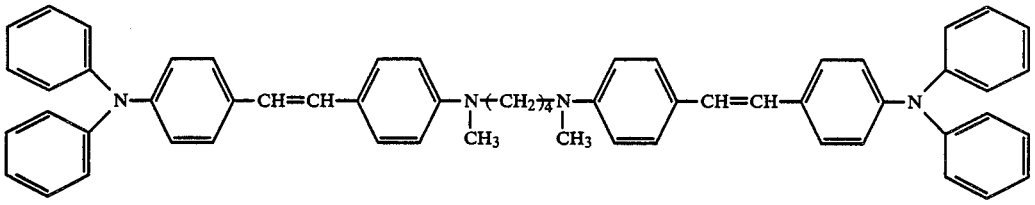

(28)

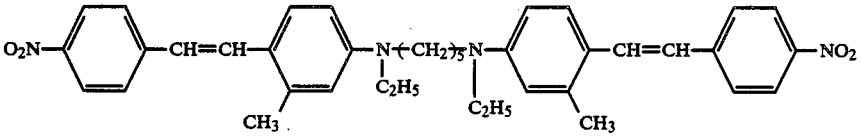

(29)

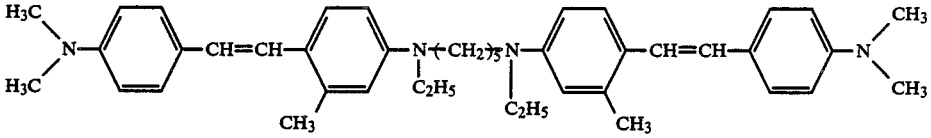

(30)

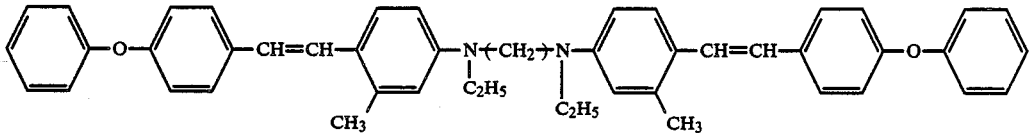

(31)

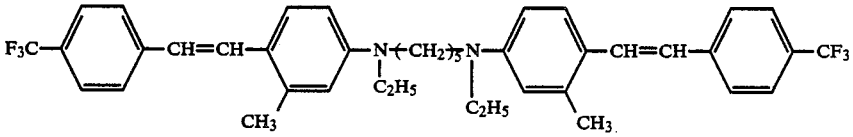

(32)

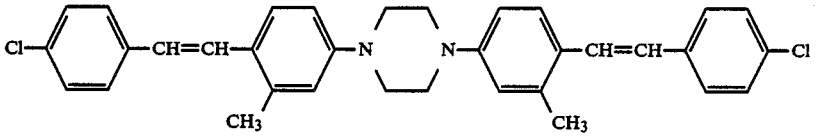

The bisstilbene compounds of formula (I) can easily be obtained by reacting a compound represented by formula (III)

$$Ar—CH_2Y \quad (III)$$

wherein Ar is as defined above; Y represents a triphenylphosphonium group of the formula

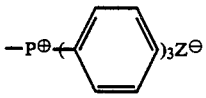

wherein $Z^{\ominus}$ represents a halogen ion or a dialkyl phosphite group of the formula $—PO(OR')_2$, wherein R' represents a lower alkyl group, with a compound represented by formula (IV)

(IV)

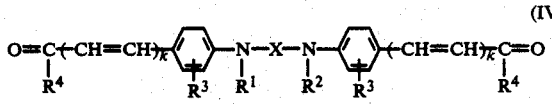

wherein X, $R^1$, $R^2$, $R^3$, $R^4$, and k are as defined above; in an organic solvent, e.g., dimethylformamide, etc., in the presence of an appropriate base, e.g., sodium hydride, sodium methoxide, potassium t-butoxide, etc.

Of the starting compounds represented by formula (IV), those wherein $R^4$ is a hydrogen atom and k is 0, which correspond to the preferred among the compounds of formula (I), can be synthesized according to the method of P. W. Hickmott, *J. Chem. Soc.*, Vol. (C) (1966), p. 666.

The photoreceptors according to the present invention containing the above-described bisstilbene compounds in accordance with the embodiments as shown in FIGS. 1 to 4.

FIG. 1 shows a photoreceptor comprising a conductive support 1 having provided thereon light-sensitive layer 21 comprising the bisstilbene compound, a sensitizing dye, and a binder (resin).

Figure 2:
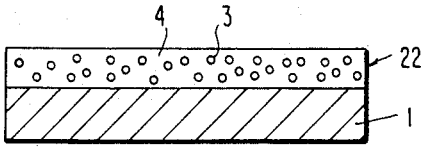

FIG. 2 shows a photoreceptor comprising a conductive support 1 having provided thereon light-sensitive layer 22 comprising charge transporting medium 4 composed of the bisstilbene compound and a binder, wherein charge generating material 3 is dispersed in the medium 4.

Figure 3:
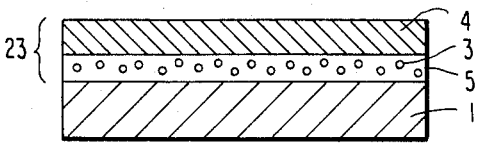

FIG. 3 illustrates a photoreceptor comprising conductive support 1, having provided thereon light-sensitive layer 23 comprising a charge generating layer 5 consisting mainly of charge generating material 3 and a charge transporting layer containing the bisstilbene compound.

Figure 4:
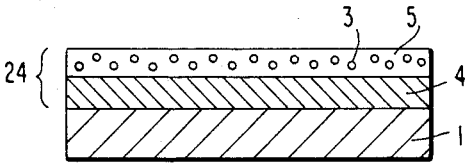

FIG. 4 illustrates a photoreceptor comprising conductive support 1 having provided thereon light-sensitive layer 24 comprising charge transporting layer 4 containing the bisstilbene compound and charge generating layer 5 consisting mainly of charge generating material 3.

In the photoreceptors shown in FIGS. 3 and 4, when a charge generating layer containing a charge generating material further contains the bisstilbene compound of the invention, the charge transporting layer may contain charge transporting material other than the bisstilbene compounds of the invention.

In the photoreceptors of FIG. 1, the bisstilbene compound acts as a photoconductive substance, through which the formation and transport of charge carriers necessary for light decay are carried out. It should be noted, however, that in this embodiment the bisstilbene compound should be sensitized with a sensitizing dye showing absorption in the visible region in order to form an image with visible light, because the bisstilbene compounds do not substantially absorb the visible region.

In the case of the photoreceptors of FIG. 2, the bisstilbene compound combined with a binder (or a binder and a plasticizer) forms a charge transporting medium, while a charge generating material, such as inorganic or organic pigments, generates electric charge. In this embodiment, the charge transporting medium principally functions to accept and transport the charge generated by the charge generating material. Therefore, it is an essential condition that the charge generating material and the charge transporting compound should not overlap each other in terms of absorption wavelength region, mostly in the visible region. In other words, light should be transmitted to reach the surface of the charge generating material in order to make the charge generating material efficiently generate charge. To achieve this effect, the bisstilbene compound according to the present invention is characterized by having no substantial absorption in the visible region so that when combined with a charge generating material generally absorbing light of the visible region, it effectively acts as a charge transporting material.

In the photoreceptors of FIG. 3, the light transmitted through charge transporting layer 4 reaches charge generating layer 5, wherein electric charge is generated. On the other hand, the charge transporting layer serves to receive and transport the charge. The mechanism accounting for the photoreceptors of FIG. 2, viz., that charge generation necessary for light decay is achieved by a charge generating material and that transport of charge is achieved by a charge transporting medium mainly comprising the bisstilbene compound of the invention, is also applicable to the photoreceptors of FIG. 3.

In the photoreceptors of FIG. 4, charge generation takes place by the action of light in charge generating layer 5, while charge transporting layer 4 serves to receive and transport the charge. The same mechanism of charge generation and charge transport as described above is also applicable to this embodiment, wherein the bisstilbene compound of the invention works as a charge transporting material.

The photoreceptors of FIG. 1 can be prepared by coating a binder solution having dissolved therein the bisstilbene compound, and, if desired, a sensitizing dye on a conductive support, followed by drying. The photoreceptors of FIG. 2 can be prepared by coating a conductive support with a solution of the bisstitlbene compound and a binder having dispersed therein fine particles of a charge generating material, followed by drying.

For the production of the photoreceptors of FIG. 3, a charge generating layer is first formed by vacuum evaporation of a charge generating material onto a conductive support, or coating a dispersion of fine particles of a charge generating material in an appropriate solvent, if desired, having dissolved therein a binder, drying the coating, and, if necessary, subjecting the coating to surface finishing, such as buffing, or controlling the film thickness. A charge transporting layer is then formed thereon by coating a solution containing the bisstilbene compound and a binder, followed by drying. The coating is carried out by a conventional means, such as a doctor blade, a wire bar, etc.

The photoreceptors of FIG. 4 can be produced by first forming a charge transporting layer on a conductive layer in the same manner as for the photoreceptors of FIG. 3 and then forming a charge generating layer thereon in the same manner as for the photoreceptors of FIG. 3.

The light-sensitive layer has a thickness of from 1 to 50 μm, and preferably from 5 to 20 μm, in the photoreceptors of FIG. 1 or 2. In the photoreceptors of FIGS. 3 and 4, the charge generating layer has a thickness of not more than 5 μm, and preferably not more than 2 μm, and the charge transporting layer has a thickness of from 3 to 50 μm, and preferably from 5 to 20 μm.

In the photoreceptors of FIG. 1, the bisstilbene compound in the light-sensitive layer is used in an amount of from 10 to 70% by weight, and preferably from 30 to 50% by weight, based on the light-sensitive layer. The sensitizing dye which can be used for imparting sensitivity to the visible region is used in an amount of from 0.1 to 5% by weight, and preferably from 0.5 to 3% by weight, based on the light-sensitive layer.

In the photoreceptors of FIG. 2, the bisstilbene compound in the light-sensitive layer is used in an amount of from 10 to 95% by weight, and preferably from 30 to 90% by weight, based on the light-sensitive layer, and the charge generating material is used in an amount of not more than 50% by weight, and preferably not more than 20% by weight, based on the light-sensitive layer. In the photoreceptors of FIGS. 3 and 4, the bisstilbene compound in the charge transporting layer is present in an amount of from 10 to 95% by weight, and preferably from 30 to 90% by weight, based on the charge transporting layer. The charge generating material in the charge generating layer is present in an amount of from 10 to 90% by weight, and preferably from 20 to 70% by weight, based on the charge generating layer in cases when the charge generating layer does not contain the bisstilbene compound; and is present in an amount of from 0.01 to 90% by weight, and preferably from 0.05 to 70% by weight, based on the charge generating layer in cases when the charge generating layer contains the bisstilbene compound, with the bisstilbene compound being present in an amount of from 0.01 to 70% by weight, and preferably from 0.05 to 50% by weight, based on the charge generating layer. In each of the photoreceptors of FIGS. 1 to 4, the binder may be used in combination with a plasticizer.

The conductive support which can be used in the photoreceptors of the invention includes metal plates or foils, such as an aluminum plate or foil, plastic films on which a metal, e.g., aluminum, is vacuum-deposited, paper having a conductive coating, and the like. Binders to be used may be any of insulating and adhesive resins, such as condensed resins, e.g., polyamide, polyurethane, polyester, epoxy resins, polyketone, polycarbonate, etc., and vinyl polymers, e.g., polyvinylketone, polystyrene, poly-N-vinylcarbazole, polyacrylamide, etc.

Plasticizers to be used include halogenated paraffins, polybiphenyl chloride, dimethylnaphthalene, dibutyl phthalate, etc.

The sensitizing dyes which can be used in the photoreceptors of FIG. 1 include triallylmethane dyes, such as Brilliant Green, Victoria Blue B, Methyl Violet, Crystal Violet, Acid Violet 6B, etc.; xanthene dyes, such as Rhodamine B, Rhodamine 6G, Rhodamine G Extra, Eosine S, Erythrocin, Rose Bengale, Fluorescein, etc.; thiazine dyes, such as Methylene Blue, etc.; Astrazone dyes, such as C.I. Basic Violet 7 (CI 48020); cyanine dyes, such as cyanine; pyrylium dyes, such as 2,6-diphenyl-4-(N,N-dimethylaminophenyl)-thiapyrylium perchlorate, benzopyrylium salts (disclosed in Japanese Patent Publication No. 25658/83), etc.; and the like.

Examples of the charge generating materials which can be used in the photoreceptors shown in FIGS. 2, 3, and 4 are listed below:

(1) selenium and selenium alloys;
(2) inorganic photoconductive materials, e.g., CdS, CdSe, CdSSe, ZnO, ZnS, etc.;
(3) phthalocyanine pigments, e.g., metal-phthalocyanine and metal-free phthalocyanine, etc.;
(4) azo pigments, such as azo pigments having a carbazole skeleton as described in Japanese patent application (OPI) No. 95033/75, azo pigments having a triphenylamine skeleton as described in Japanese patent application (OPI) No. 132547/75, azo pigments having a styrylstilbene skeleton as described in Japanese patent application (OPI) Nos. 133445/75 and 42352/84, azo pigments having a naphthalene skeleton as described in Japanese patent application (OPI) Nos. 123541/83 and 217556/83, trisazo pigments as described in Japanese patent application (OPI) No. 179746/85, azo pigments having a thiophene skeleton as described in Japanese patent application (OPI) No. 223433/84, etc.;
(5) perylene pigments, such as perylenic anhydride, perylenic acid imide, etc.;
(6) indigoid dyes;
(7) quinacridone dyes;
(8) polycyclic quinones; such as anthraquinones, pyrenequinones, anthanthrones, flavanthrones, etc.;
(9) bisbenzimidazole pigments;
(10) cyanine dyes;
(11) squaric methine dyes;
(12) indanthrone pigments;
(13) xanthene dyes;
(14) charge transporting complexes comprising an electron donor, e.g., poly-N-vinylcarbazole, etc., and an electron acceptor, e.g., trinitrofluorenone, etc.;
(15) eutectic complexes formed by pyrylium salt dyes and polycarbonate resins; and
(16) amorphous silicon.

Among these charge generating materials azo dyes are preferred.

Charge transporting materials other than the bisstilbene compounds of the present invention which can be used in the charge transporting layer are classified into electron transporting compounds and positive hole transporting compounds, and both of which can be used in the electrophotographic photoreceptors of the present invention. Examples of the electron transporting compounds include compounds having an electron attractive group, such as 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazolechloranil, 2,3-dichloro-5,6-dicyanobenzoquinone, 2,4,7-trinitro-9,10-phenanthrenequinone, tetrachlorophthalic anhydride, tetracyanoethylene, tetracyanoquinonedimethane, etc.

The positive hole transporting compounds are compounds having an electron donative group including high molecular weight compounds, such as pyridonylcarbazole and its derivative as disclosed in Japanese Patent Publication No. 10966/59; vinyl polymers, e.g., polyvinylpyrene, polyvinylanthracene, poly-2-vinyl-4-(4'-dimethylaminophenyl)-5-phenyl-oxazole, poly-3-vinyl-N-carbazole, etc., as disclosed in Japanese Patent Publication Nos. 18674/68 and 19192/68; polymers described in Japanese Patent Publication No. 19193/68, e.g., polyacenaphthylene, polyindene, a copolymer of acenaphthylene and styrene, etc.; condensed resins, e.g., pyrene-formaldehyde resins, bromopyrene-formaldehyde resins, ethylcarbazole-formaldehyde resins, etc., as disclosed in Japanese Patent Publication No. 13940/81; and various kinds of triphenylmethane polymers as disclosed in Japanese patent application (OPI) Nos. 90833/81 and 161550/81; and low molecular weight compounds, such as triazole derivatives as described in U.S. Pat. No. 3,112,197; oxadiazole derivatives as described in U.S. Pat. No. 3,189,447; imidazole derivatives as described in Japanese Patent Publication No. 16096/62; polyarylalkane derivatives as disclosed in U.S. Pat. Nos. 3,615,402, 3,820,989, and 3,542,544, Japanese Patent Publication Nos. 555/70 and 10983/72, and Japanese patent application (OPI) Nos. 93224/76, 17105/80, 4148/81, 108667/80, 156953/80, and 36656/81; pyrazoline derivatives and pyrazolone derivatives as disclosed in U.S. Pat. Nos. 3,180,729 and 4,278,746 and Japanese patent application (OPI) Nos. 88064/80, 88065/80, 105537/74, 51086/80, 80051/81, 88141/81, 45545/82, 112637/79, and 74546/80; phenylenediamine derivatives as disclosed in U.S. Pat. No. 3,615,404, Japanese Patent Publication No. 10105/76, Japanese patent application (OPI) Nos. 83435/79, 110836/79, and 119925/79, and Japanese Patent Publication Nos. 3712/71 and 28336/72; arylamine derivatives as disclosed in U.S. Pat. No. 3,567,450, Japanese patent publication No. 35702/74, West German Patent (DAS) No. 1110518, U.S. Pat. Nos. 3,180,703, 3,240,597, 3,658,520, 4,232,103, 4,175,961, and 4,012,376, Japanese patent application (OPI) Nos. 144250/80 and 119132/81, Japanese Patent Publication No. 27577/64 and Japanese patent application (OPI) No. 22437/81; amino-substituted chalcone derivatives as disclosed in U.S. Pat. No. 3,526,501; N,N-bicarbazyl derivatives as disclosed in U.S. Pat. No. 3,542,546; oxazole derivatives as disclosed in U.S. Pat. No. 3,257,203; styrylanthracene derivatives as disclosed in Japanese patent application (OPI) No. 46234/81; fluorenone derivatives as disclosed in Japanese patent application (OPI) No. 110837/79; and hydrazone derivatives as disclosed in U.S. Pat. Nos. 3,717,462 and 4,150,987, and Japanese patent application (OPI) Nos. 52063/80, 52064/80, 46760/80, 85495/80, 11350/82, and 148749/82.

If desired, the photoreceptors of the present invention may have an adhesive layer or a barrier layer between the conductive support and the light-sensitive layer. Materials to be used in these auxiliary layers include gelatin, casein, polyvinyl alcohol, ethyl cellulose, carboxymethyl cellulose, vinylidene chloride latices as described in Japanese patent application (OPI) No. 84247/84, styrene-butadiene latices as described in Japanese patent application (OPI) No. 114544/84, etc., as well as the above-described high molecular weight polymers useful as binders. These layers preferably have a thickness of not more than 1 μm.

The electrophotographic photoreceptors in accordance with the present invention are, in general, characterized by high sensitivity and excellent durability.

The electrophotographic photoreceptors of the present invention can be applied widely to electrophotographic copying machines and printers using a laser beam or a Braun tube as a light source. In addition, they can also be used for the production of printing plates having high resolving power, high durability, and high sensitivity, in which the bisstilbene compound of the invention and a charge generating material are dispersed in an alkali-soluble resin, e.g., a phenol resin, and the dispersion is coated on a conductive support, e.g., an aluminum sheet, dried, imagewise exposed to light, developed with a toner and then etched with an alkali aqueous solution, as described, e.g., in Japanese patent publication No. 17162/62 and Japanese patent application (OPI) Nos. 19063/80, 161250/80, and 147656/82. Likewise, printed circuits can be produced by using the photoreceptors of the invention.

This invention will now be illustrated in greater detail with reference to the following examples, but it should be understood that they are not intended to limit the present invention. In these examples, all the parts are given by weight.

SYNTHESIS EXAMPLE

Synthesis of Compound (2)

In 30 ml of N,N-dimethylformamide were dissolved 4.85 g (0.02 mol) of diethyl 4-methylbenzylphosphonate and 3.80 g (0.01 mol) of bis(N-n-butyl-4-formulanilino)-butane, and 5.79 g of sodium methoxide (28 wt% methanolic solution) was added to the solution at 20° C. The resulting mixture was heated at 60° C. for 10 hours, followed by cooling to room temperature, and 30 ml of ethanol was added thereto. The formed crystals were collected by filtration, washed with water and recrystallized from a mixed solvent of ethyl acetateethanol to give 4.36 g (yield: 78%) of Compound (2) as yellow needle-like crystals.

Melting Point: 169°–170° C.

Elementary Analysis for $C_{40}H_{48}N_2$: Calcd. (%): C 86.28, H 8.69, N 5.03, Found (%): C 86.48, H 8.73, N 4.79.

EXAMPLE 1

Selenium was vacuum-evaporated onto an about 300 μm thick grained aluminum sheet to form a charge generating layer having a thickness of 0.4 μm. A solution of 10 parts of Compound (2) and 10 parts of bisphenol A polycarbonate (Panlite K-1300; produced by Teijin Limited) in 130 parts of dichloromethane was coated on the charge generating layer using a wire round rod, followed by drying to form a charge transporting layer having a thickness of about 12 μm. There was obtained an electrophotographic photoreceptor having a light-sensitive layer composed of two layers.

The resulting photoreceptor was negatively charged by corona discharge of −5 KV by the use of an electrostatic copying paper testing equipment (SP-428, manufactured by Kawaguchi Denki Seisakusho) and then irradiated with light emitted from a tungsten lamp of 2,854° K. at an illuminance of 2.0 lux. The half-decay, i.e., the time required for the surface potential to be reduced to one-half its initial value, was determined to obtain a half-decay exposure amount ($E_{50}$: lux.sec). As a result, the half-decay exposure amount was 1.8 lux.sec.

After the above-described charging and light exposure were repeated 3,000 times, $E_{50}$ was 2.0 lux.sec, indicating an extremely small fluctuation in sensitivity.

EXAMPLES 2 TO 6

A photoreceptor was produced in the same manner as described in Example 1, except using Compounds (1), (7), (10), (16) and (26), respectively, in place of Compound (2). A half-decay exposure amount ($E_{50}$) when negatively charged was determined, and the results obtained are shown in Table 1 below.

TABLE 1

| Example No. | Bisstilbene Compound (I) | $E_{50}$ (lux · sec) |
|---|---|---|
| 2 | (1) | 2.2 |
| 3 | (7) | 3.0 |
| 4 | (10) | 2.3 |
| 5 | (16) | 1.9 |
| 6 | (26) | 3.3 |

EXAMPLE 7

Five parts of beta-copper phthalocyanine were added to 660 parts of dichloromethane, followed by ultrasonic dispersion. In the dispersion were dissolved 40 parts of bisphenol A polycarbonate (Panlite K-1300) and 40 parts of Compound (2) to prepare a coating composition. The coating composition was coated on a transparent conductive support comprising a 100 μm thick polyethylene terephthalate sheet having provided thereon an indium oxide deposited film (surface resistivity: $10^3$ Ω) using a wire round rod and dried to obtain a photoreceptor having a thickness of about 10 μm.

The half-decay exposure amount ($E_{50}$) of the resulting photoreceptor when positively charged by corona discharge of +5 KV was 3.5 lux·sec.

EXAMPLE 8

Two parts of a trisazo pigment of the following formula and 4 parts of a polyester resin (Vylon 200, manufactured by Toyo Spinning Co., Ltd.) were added to 7 parts of tetrahydrofuran, and the mixture was dispersed in a ball mill for 12 hours. The resulting dispersion was coated on a conductive support comprising a 100 μm thick polyethylene terephthalate sheet having an aluminum deposited film; (surface resistivity: $4\times10^2$ Ω) using a wire round rod, followed by drying to form a charge generating layer having a thickness of about 0.5 μm.

A solution of 10 parts of Compound (2) and 10 parts of bisphenol A polycarbonate (Panlite K-1300) in 120 parts of dichloromethane was coated on the charge generating layer with a wire wound rod and dried to form a charge transporting layer having a thickness of about 14 μm.

A half-decay exposure amount ($E_{50}$) of the resulting photoreceptor as determined in the same manner as in Example 1 was 1.6 lux·sec.

Trisazo Pigment:

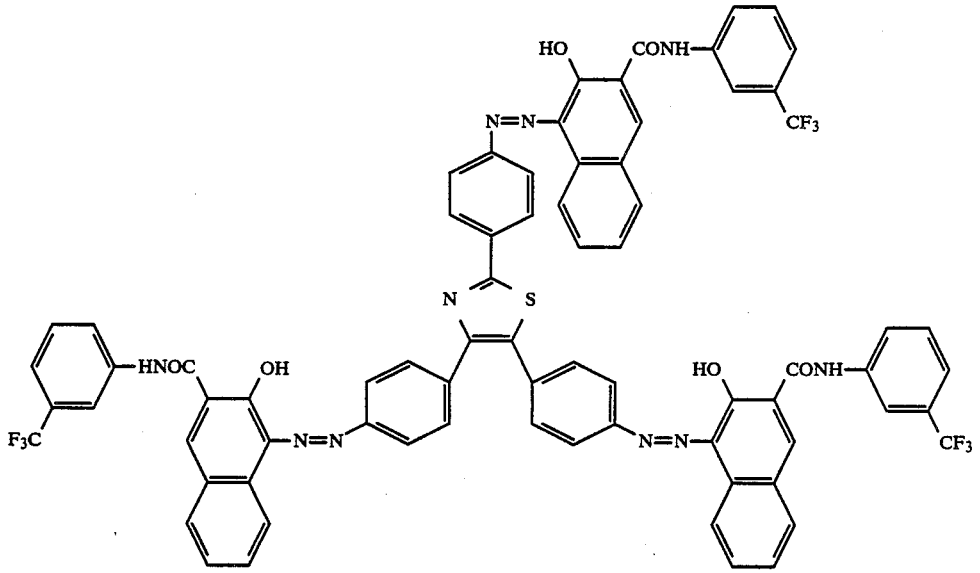

EXAMPLES 9 TO 20

A photoreceptor having a two-layer structure was prepared in the same manner as described in Example 8, except replacing Compound (2) with Compound (4), (5), (9), (11), (13), (18), (19), (21), (24), (25), (30), or (32).

A half-decay exposure amount ($E_{50}$) was determined in the same manner as in Example 1, and the results obtained are shown in Table 2 below.

TABLE 2

| Example No. | Bisstilbene Compound (I) | $E_{50}$ (lux · sec) |
|---|---|---|
| 9 | (4) | 1.6 |
| 10 | (5) | 1.9 |
| 11 | (9) | 1.5 |
| 12 | (11) | 1.7 |
| 13 | (13) | 2.3 |
| 14 | (18) | 1.7 |
| 15 | (19) | 1.3 |
| 16 | (21) | 1.5 |
| 17 | (24) | 1.9 |
| 18 | (25) | 2.4 |
| 19 | (30) | 2.1 |
| 20 | (32) | 3.0 |

EXAMPLE 21

Eight parts of Compound (2), 10 parts of bisphenol A polycarbonate (panlite K-1300) and 0.12 part of an astrazon dye of the following formula were dissolved in 100 parts of dichloromethane to prepare a coating composition. The coating composition was coated on a transparent conductive support comprising a 100 μm thick polyethylene terephthalate sheet having an indium oxide deposited film (surface resistivity: $10^3$ Ω) with a wire round rod and dried to obtain a photoreceptor having a thickness of about 10 μm.

The resulting photoreceptor was positively charged by corona discharge of +5 KV, and a half-decay exposure amount ($E_{50}$) was found to be 13.2 lux·sec.

Astrazon Dye:

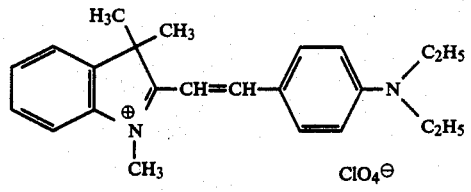

EXAMPLE 22

Five parts of the same trisazo pigment as used in Example 8, 40 parts of Compound (2) and 100 parts of a benzyl methacrylate-methacrylic acid copolymer (methacrylic acid content: 32.9%; $[\eta]=0.12$ in methyl ethyl ketone at 30° C.) were dispersed in 660 parts of dichloromethane by ultrasonic wave. The resulting dispersion was coated on a grained aluminum plate having a thickness of 0.25 mm and dried to obtain an electrophotographic printing plate precursor. The precursor was charged by corona discharge (+6 KV) in the dark so as to have a surface potential of +600 V and then exposed to light emitted from a tungsten lamp (color temperature: 2,854° K.) at an illuminance of 2.0 lux. A half-decay exposure amount ($E_{50}$) was 2.0 lux·sec.

The printing plate precursor was charged in the dark so as to have a surface potential of about +400 V and imagewise exposed to light through a transparent positive original in intimate contact therewith. The exposed plate was dipped in a developing solution comprising 5 g of polymethyl methacrylate (toner) finely dispersed in 1 liter of a petroleum solvent (Isopar H, produced by Esso Standard Co,, Ltd.) and 0.01 g of soybean lecithin thereby to form a clear positive toner image. The plate was heated at 100° C. for 30 seconds to fix the toner image. The printing plate precursor was then dipped in a solution consisting of 70 g of sodium metasilicate hydrate, 140 ml of glycerin, 550 ml of ethylene glycol and 150 ml of ethanol for about 1 minute, followed by washing with running water while lightly brushing to remove the light-sensitive layer in the areas where no toner was attached, to thereby obtain a printing plate.

Instead of using the above-described developing solution, the electrostatic latent image was subjected to magnetic brush development using a toner for Xerox 3500 (produced by Fuji Xerox Co., Ltd.), followed by heating at 80° C. for 30 seconds to fix the toner image. The light-sensitive layer in the areas where no toner was attached was removed with an alkali solution to obtain a printing plate.

When the thus-produced printing plate was mounted on an offset printer (Hamadastar 600CD) and printing was carried out, 50,000 prints that were very clear with no background stain could be obtained.

EXAMPLE 23

A solution of 3 parts of Compound (2) and 5 parts of a polyester resin (Vylon 200, produced by Toyo Spinning Co., Ltd.) in 44 parts of tetrahydrofuran and 5 g of a disazo pigment of the following formula were dispersed in a ball mill for 20 hours. The resulting dispersion was coated on a conductive support comprising a 75 μm thick polyethylene terephthalate film having an aluminum deposited film (surface resistivity: $10^3$ Ω) with a wire round rod and dried to form a charge generating layer having a thickess of 0.6 μm.

Disazo Pigment:

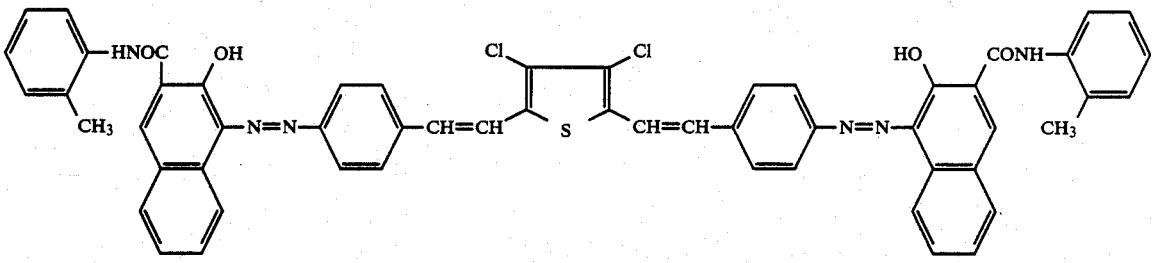

A solution consisting of 2.4 parts of a hydrazone compound of the following formula as a charge transporting material, 4 parts of bisphenol A polycarbonate, 13,3 parts of dichloromethane 26.6 parts of 1,2-dichloroethane was coated on the charge generating layer and dried to form a charge transporting layer having a thickness of 11 μm. The resulting electrophotographic photoreceptor having a two-layered light-sensitive layer was designated as Sample A.

Hydrazone Compound:

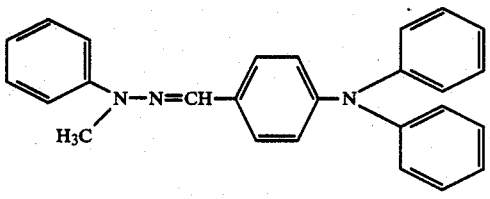

For comparison, Sample B was produced in the same manner as described above except that Compound (2) was not used.

Each of Samples A and B was charged by corona discharge of −6 KV for 5 seconds by means of an electrostatic copying paper testing equipment (SP-428, produced by Kawaguchi Denki K.K.) and allowed to stand for 10 seconds in a dark place. Then, the potential of the sample was determined and referred to as initial surface potential $V_0$. Then, the sample was irradiated with light emitted from a tungsten lamp (color temperature: 2,854° K.) at an illuminance of 2 lux to determine a half-decay exposure amount ($E_{50}$). The results obtained are as follows:

Sample A, $E_{50}=2.1$ lux·sec,

Sample B, $E_{50}=3.4$ lux·sec.

The above measurement was repeated 200 times, and the results obtained are shown in Table 3.

TABLE 3

| Sample | Initial Potential ($V_0$) (V) | Potential ($V_0$) after Repeated Use of 200 Times (V) |
|---|---|---|
| A | −554 | −535 |
| B | −511 | −150 |

It can be seen from the results of Table 3 that Sample A wherein the bisstilbene compound of the invention is added to the charge generating layer is superior in sensitivity to Sample B containing no bisstilbene compound and that the reduction in initial surface potential due to repeated charging processing is much smaller in Sample A than in Sample B.

EXAMPLES 24 TO 29

An electrophotographic photoreceptor was produced in the same manner as in Example 23 but replacing Compound (2) with Compound (1), (3), (5), (6), (12), or (31).

Then, the resulting photoreceptor was tested for the half-decay exposure amount ($E_{50}$), the initial surface potential ($V_0$) and the initial surface potential after repeated use of 200 times in the same manner as described in Example 23. The results obtained are shown in Table 4.

TABLE 4

| Example No. | $E_{50}$ (lux · sec) | $V_0$ Initial Potential (V) | $V_0$ Potential after 200 Times (V) |
|---|---|---|---|
| 24 | 2.8 | −602 | −587 |
| 25 | 2.4 | −648 | −562 |
| 26 | 2.4 | −702 | −691 |
| 27 | 2.9 | −728 | −698 |
| 28 | 2.5 | −648 | −549 |
| 29 | 2.1 | −656 | −539 |

As can be seen from the above results, photoreceptors wherein the bisstilbene compounds are added to the charge generating layer have higher sensitivity and reduction in charged potential due to repeated charging processing is much smaller as compared with Sample B of Example 23.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a conductive support having provided thereon a light-sensitive layer, wherein said light-sensitive layer contains at least one bisstilbene or bisstyryl compound represented by formula (I)

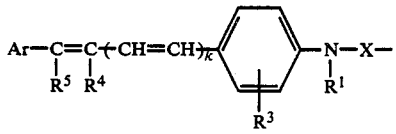

(I)

-continued

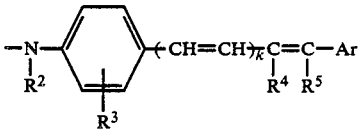

wherein Ar represents a substituted or unsubstituted atomatic carbon ring residue or a substituted or unsubstituted aromatic heterocyclic residue; $R^1$ and $R^2$ each represents a substituted or unsubstituted alkyl group, a substituted or unsubstituted aralkyl group, or a substituted or unsubstituted aryl group, or $R^1$ and $R^2$ together form an N-containing heterocyclic group; $R^3$ represents a hydrogen atom, a halogen atom, a substituted or unsubstituted alkyl group, a substituted or unsubstituted alkoxy group, a substituted or unsubstituted aryl group, a substituted or unsubstituted aralkyl group, or a substituted or unsubstituted aryloxy group; $R^4$ represents a hydrogen atom, a substituted or unsubstituted alkyl group, a substituted or unsubstituted aralkyl group, or a substituted or unsubstituted aryl group; $R^5$ represents a hydrogen atom, a halogen atom, a nitro group, a cyano group, a substituted or unsubstituted alkyl group, a substituted or unsubstituted aralkyl group, or a substituted or unsubstituted aryl group, or $R^5$ together with Ar forms an aromatic ring; k represents 0 or 1; and x represents a group represented by formula (II)

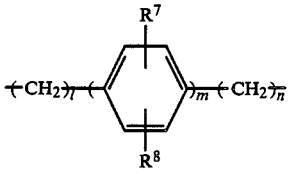

(II)

wherein $R^7$ and $R^8$ each represents a hydrogen atom, a halogen atom, a substituted or unsubstituted alkyl group, a substituted or unsubstituted alkoxy group, a substituted or unsubstituted aryl group, or a substituted or unsubstituted aryloxy group, or $R^7$ and $R^8$ together form a condensed polycyclic aromatic ring; l and n each represents 0 or an integer of from 1 to 6; and m represents 0 or 1.

2. An electrophotographic photoreceptor as in claim 1, wherein $R^1$ and $R^2$ each represents a methyl group, an ethyl group, an n-butyl group, an n-hexyl group, a benzyl group, or a phenyl group.

3. An electrophotographic photoreceptor as in claim 1, wherein $R^3$ represents a hydrogen atom, a methyl group, an ethyl group, a methoxy group, an ethoxy group, a fluorine atom, a chlorine atom, or a bromine atom.

4. An electrophotographic photoreceptor as in claim 1, wherein $R^4$ represents a hydrogen atom, a methyl group, an ethyl group, a phenyl group, a benzyl group, a p-(dimethylamino)phenyl group, or a p-(diethylamino)phenyl group.

5. An electrophotographic photoreceptor as in claim 1, wherein $R^5$ represents a hydrogen atom, or a phenyl group.

6. An electrophotographic photoreceptor as in claim 1, wherein k is 0.

7. An electrophotographic photoreceptor as in claim 1, wherein X represents an ethylene group, a butylene group, a pentylene group, a hexylene group, or a p-xylene group.

8. An electrophotographic photoreceptor as in claim 1, wherein said light-sensitive layer is composed of a charge generating layer having a thickness of not more than 5 μm containing a charge generating material and a charge transporting layer containing said compound of formula (I).

9. An electrophotographic photoreceptor as in claim 8, wherein said charge generating layer further contains said compound of formula (I).

10. An electrophotographic photoreceptor as in claim 8, wherein $R^1$ and $R^2$ each represents a methyl group, an ethyl group, an n-butyl group, an n-hexyl group, a benzyl group, or a phenyl group, $R^3$ represents a hydrogen atom, a methyl group, an ethyl group, a methoxy group, an ethoxy group, a fluorine atom, a chlorine atom, or a bromine atom, $R^4$ represents a hydrogen atom, a methyl group, an ethyl group, a phenyl group, a benzyl group, a p-(dimethylamino)phenyl group, or a p-(diethylamino)phenyl group, $R^5$ represents a hydrogen atom, or a phenyl group, k is 0, and X represents an ethylene group, a butylene group, a pentylene group, a hexylene group, or a p-xylene group.

11. An electrophotographic photoreceptor as in claim 1, wherein said light-sensitive layer contains at least one bisstilbene or bisstyryl compound represented by formula (I) and a binder, said bisstilbene or bisstyryl compound being present in an amount of from 10 to 70% by weight based on the light-sensitive layer.

12. An electrophotographic photoreceptor as in claim 11, wherein said light-sensitive layer further contains a sensitive dye in an amount of from 0.1 to 5% by weight based on the light-sensitive layer.

13. An electrophotographic photoreceptor as in claim 1, wherein said light-sensitive layer contains at least one bisstilbene or bisstyryl compound represented by formula (I), a charge generating material in an amount of not more than 50% by weight and a binder, said bisstilbene or bisstyryl compound being present in an amount of from 10 to 95% by weight based on the light-sensitive layer.

14. An electrophotographic photoreceptor as in claim 8, wherein said charge transporting layer contains a bisstilbene or bisstyryl compound represented by formula (I) in an amount of from 10 to 95% by weight based on the charge transporting layer.

15. An electrophotographic photoreceptor as in claim 9, wherein said charge generating layer contains a bisstilbene or bisstyryl compound represented by formula (I) in an amount of from 0.01 to 70% by weight and a charge generating material in an amount of from 0.01 to 90% by weight, based on the charge generating layer.

16. An electrophotographic photoreceptor as in claim 1, wherein said light-sensitive layer is composed of a charge generating layer containing a bisstilbene or bisstyryl compound represented by formula (I), and a charge transporting layer containing a charge transporting material.

17. An electrophotographic photoreceptor as in claim 16, wherein said charge generating layer contains a bisstilbene or bisstyryl compound represented by formula (I) in an amount of from 0.01 to 70% by weight and a charge generating material in an amount of from 0.01 to 90% by weight, based on the charge generating layer.

* * * * *